US006161458A

United States Patent [19]

Spatafora

[11] Patent Number: 6,161,458

[45] Date of Patent: Dec. 19, 2000

[54] METHOD AND UNIT FOR PROCESSING SHEET MATERIAL

[75] Inventor: Mario Spatafora, Bologna, Italy

[73] Assignee: G.D Societa per Azioni, Bologna, Italy

[21] Appl. No.: 09/262,705

[22] Filed: Mar. 4, 1999

[30] Foreign Application Priority Data

Mar. 5, 1998 [IT] Italy ..... B098A0126

[51] Int. Cl.[7] ..... B26D 1/00

[52] U.S. Cl. ..... 83/13; 83/304; 83/344; 83/507; 83/698.21; 83/698.61

[58] Field of Search ..... 83/503, 506, 507, 83/344, 130 R, 698.5, 698.61, 305, 304, 698.21, 698.11; 335/215

[56] References Cited

U.S. PATENT DOCUMENTS

| | | | |
|---|---|---|---|
| 2,706,524 | 4/1955 | Hall | 83/503 |
| 4,667,550 | 5/1987 | Eiting | 83/503 |
| 5,207,138 | 5/1993 | Sato et al. | 83/337 |
| 5,389,845 | 2/1995 | Brimhall | 310/26 |
| 5,703,553 | 12/1997 | Bushko et al. | 335/215 |
| 5,720,210 | 2/1998 | Okahashi | 83/342 |

FOREIGN PATENT DOCUMENTS

| | | |
|---|---|---|
| 0707928 | 4/1996 | European Pat. Off. . |
| 0841133 | 5/1998 | European Pat. Off. . |
| 1029277 | 4/1958 | Germany . |
| 2266487 | 11/1993 | United Kingdom . |

*Primary Examiner*—M. Rachuba
*Attorney, Agent, or Firm*—Ladas & Parry

[57] ABSTRACT

A method and unit for processing sheet material, whereby the sheet material is processed between two rollers rotating about respective substantially parallel axes and cooperating mutually according to a given law of interaction depending on the spatial relationship of the two rollers; the spatial relationship being adjusted, in use, instant by instant and in accordance with the given law of interaction by adjusting the position of the axes of the two rollers by varying an electromagnetic field acting on an actuating body made of electromagnetically strictive material and interposed between the two rollers.

9 Claims, 1 Drawing Sheet

METHOD AND UNIT FOR PROCESSING SHEET MATERIAL

FIELD OF THE INVENTION

The present invention relates to a method of processing sheet material.

In particular, the present invention relates to a method of processing strip paper or similar material.

BACKGROUND OF THE INVENTION

In the following description, specific reference is made purely by way of example to the cutting or embossing of strip paper on automatic packing machines.

Automatic packing machines are known to feature cutting or embossing units comprising two mutually-cooperating rollers, which are fitted to respective supports, rotate about respective substantially parallel axes, and define a work region to which the sheet material is fed for processing by a pair of mutually-cooperating tools, each fitted to a respective roller.

Optimum performance of the tools, in terms of quality processing of the material and minimum tool wear, depends on the way in which the tools mate, i.e. on the tools cooperating mutually according to a given law of interaction, in turn, depending on the spatial relationship of the two rollers. For example; two cutting rollers fitted with respective numbers of blades cooperating in pairs operate best when the blades in each pair skim over each other with no interference.

An error or shift in the spatial relationship of the axes of the two rollers results in impaired interaction of the tools and, consequently, in poor-quality work; and, especially in the case of cutting units, tool wear, i.e. of the blades, is greatly increased in the event of interference between the blades in each pair.

In the case of two rollers fitted with respective numbers of tools, the spatial relationship of the roller axes providing for optimum interaction of one pair of tools rarely also applies to the other pairs, due, for example, to the different tool assembly tolerances involved, so that setting up the processing unit is a particularly painstaking, and hence expensive, job, which invariably amounts to a trade-off between the spatial relationships of the roller axes providing for optimum working conditions of all the tool pairs.

Moreover, optimum working conditions are affected fairly rapidly by in-service slack and wear of the tools, so that the processing unit must be adjusted frequently, thus further increasing maintenance cost.

EP-A1-707928 and EP-A1-841133 (intermediate document according to Art. 54(3) EPC) disclose a rotatory cutter comprising a knife roller and a plain roller cooperating with each other, and a clearance adjusting mechanism disposed on both end portions of the two rollers for adjusting in use the contact pressure between the knife roller and the plain roller. The clearance adjusting mechanism comprises a toggle mechanism coupled with a threaded member driven by a gear box connected to an electric motor.

The aforementioned clearance adjusting mechanism has several drawbacks, which stem from the fact that such mechanism generates the movement of the two rollers mechanically, and is therefore a relatively slow and low-precision mechanism. Furthermore, the above clearance adjusting mechanism is quite expensive owing to its generating a high precision movement combined with a relatively strong force.

SUMMARY OF THE INVENTION

According to the present invention, there is provided a method of processing sheet material, wherein the sheet material is processed between two rollers, which are rotated about respective substantially parallel axes and cooperate mutually according to a given law of interaction depending on a spatial relationship of the two rollers; said spatial relationship being regulated in accordance with said given law of interaction by adjusting a spatial position of each said axis with respect to the other said axis; characterized in that said spatial position of each said axis with respect to the other said axis is adjusted instant by instant by varying an electromagnetic field acting on actuating means made of electromagnetically strictive material and connected to the two rollers.

The present invention also relates to a unit for processing sheet material.

According to the present invention, there is provided a unit for processing sheet material, the unit comprising two mutually-cooperating work rollers cooperating mutually according to a given law of interaction depending on a spatial relationship of the two rollers; drive means for rotating the two rollers about respective substantially parallel axes; and adjusting means for adjusting said spatial relationship and in accordance with said given law of interaction by adjusting a spatial position of each said axis with respect to the other said axis; the unit being characterized in that said adjusting means comprise at least one actuating body made of electromagnetically strictive material and connected to at least one of said rollers, and means for producing a variable electromagnetic field acting on said actuating body.

BRIEF DESCRIPTION OF THE DRAWINGS

A non-limiting embodiment of the present invention will be described by way of example with reference to the accompanying drawings, in which.

DETAILED DESCRIPTION OF THE INVENTION

Figure 1:
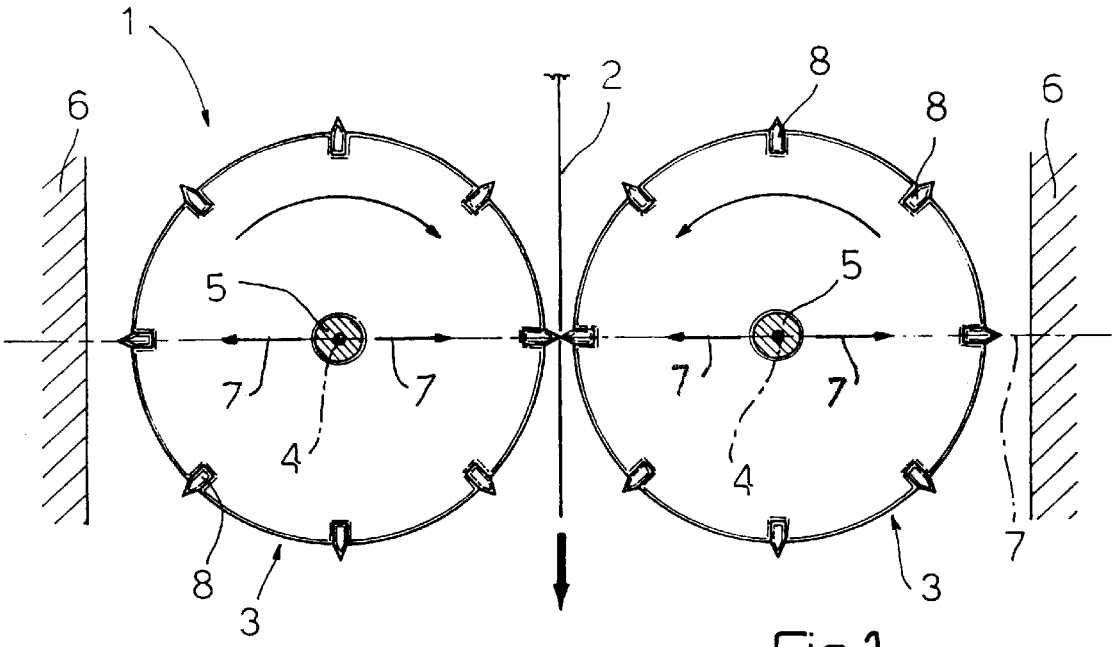
FIG. 1 shows a schematic front view, with parts removed for clarity, of a preferred embodiment of the unit according to the present invention.

Numeral 1 in FIG. 1 indicates as a whole a unit for cutting sheet material 2 typically defined by a strip of paper or similar material, and which is cut between two known mutually-cooperating rollers 3 rotating about respective substantially parallel, horizontal axes 4 perpendicular to the FIG. 1 plane.

Each roller 3 comprises a shaft 5 fitted to a frame 6 to rotate about respective axis 4 and move in an adjusting direction 7 perpendicular to axes 4; and cutting unit 1 comprises a known drive device (not shown) connected to each shaft 5 to rotate rollers 3 substantially continuously, at the same angular speed, and in opposite directions about respective axes 4.

In a further embodiment not shown, adjusting direction 7, i.e. the direction in which the mutual position of axes 4 of rollers 3 is adjusted, is not perpendicular to axes 4 of rollers 3.

Each roller 3 comprises a number of equally spaced peripheral blades 8, each of which cooperates, as rollers 3 rotate, with a corresponding blade 8 on the other roller 3. That is, each blade 8 on one roller 3 forms a pair of mutually-cooperating blades 8 with a corresponding blade 8 on the other roller 3.

Quality cutting of material 2 with minimum wear of blades 8 normally depends on the two corresponding blades 8 cooperating according to a given law of interaction, which in turn depends on a particular spatial relationship of the two rollers 3.

More specifically, for a pair of blades 8 cooperating mutually at a given cutting station, said law of interaction amounts to the force exchanged between the two blades 8 during the cutting operation—hereinafter referred to as "interaction force"—falling within a given range of values. The value of the interaction force substantially depends on the degree of interference between the two blades 8, and therefore on the distance, at the time the cut is made, between axes 4 of rollers 3.

In general, if the interaction force value is below a first threshold corresponding to the lower limit of said range, blades 8 are too far apart and material 2 is cut poorly. Conversely, if the interaction force value is above a second threshold corresponding to the upper limit of said range, blades 8 are too close together and, despite effectively cutting material 2, are subject to severe wear.

Figure 2:
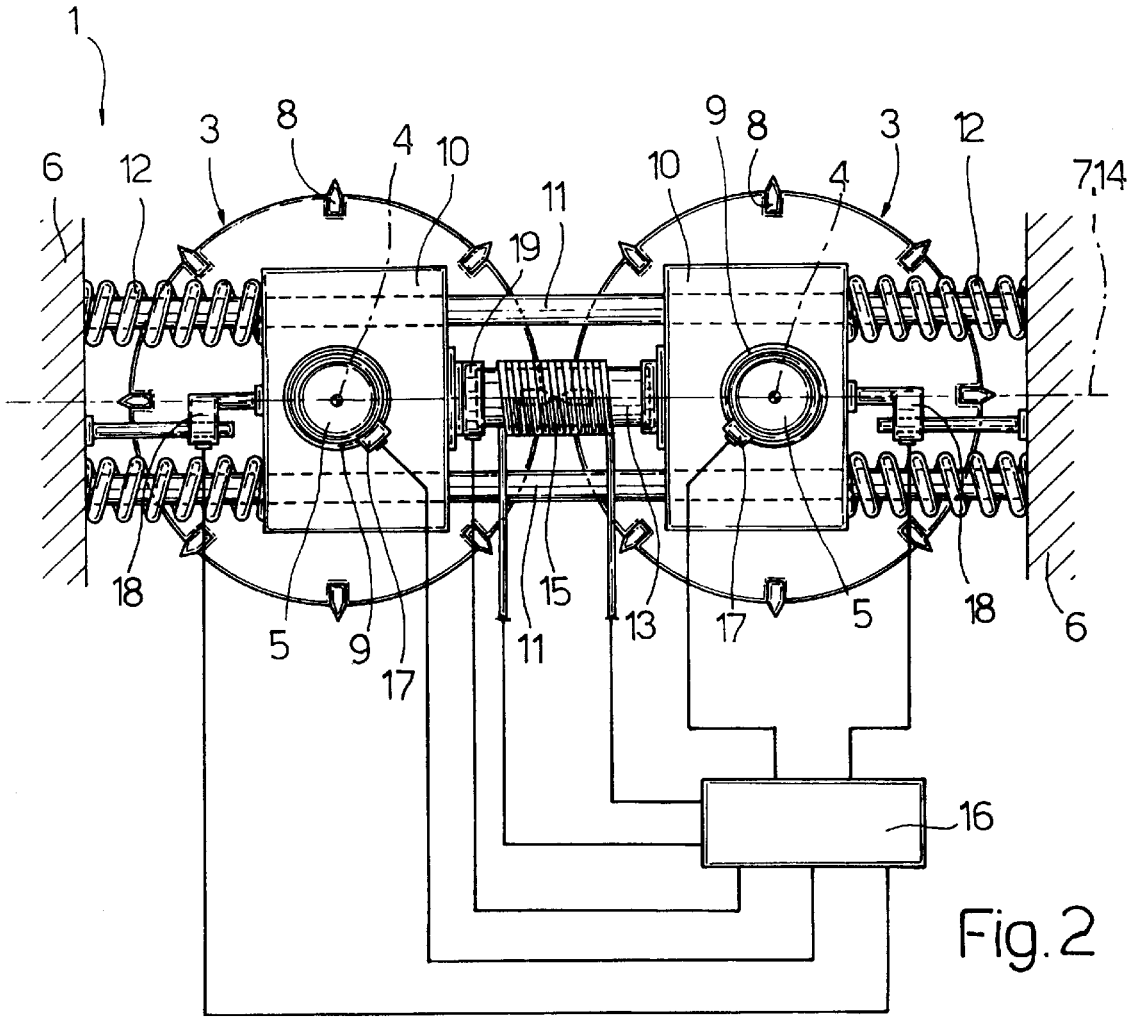
FIG. 2 shows a further schematic front view of the FIG. 1 unit.

As shown more clearly in FIG. 2, each shaft 5 is fitted to frame 6 by respective ball bearings 9 (only one shown) located on both sides of respective roller 3 and housed inside respective supporting bodies 10 (only one shown) which slide along cylindrical guides 11 extending parallel to adjusting direction 7 and fitted at opposite ends to frame 6.

That is, in the example shown, cutting unit 1 comprises four supporting bodies 10 (only two shown) divided into two pairs (only one shown), each of which supports the same ends of the two shafts 5. The supporting bodies 10 in each of said two pairs are pushed towards each other by elastic members comprising springs 12, each of which is coaxial with a respective guide 11 and located between frame 6 and respective supporting body 10; and the supporting bodies 10 in each pair are maintained a given distance apart, in opposition to springs 12, by a cylindrical actuating body 13 interposed between supporting bodies 10 and having a longitudinal axis 14 parallel to adjusting direction 7 and perpendicular to axes 4 of rollers 3.

In a further embodiment not shown, one of the supporting bodies 10 in each pair is integral with frame 6, and only the other supporting body 10 slides along guides 11.

Each actuating body 13 is wound with a coil 15 of conducting material, which, when applied with electric current, generates in actuating body 13 a magnetic field in a direction substantially parallel to the longitudinal axis 14 of actuating body 13.

Actuating bodies 13 are made of magnetostrictive material, i.e. material which is deformed when subjected to a magnetic field. In particular, each actuating body 13 is made of magnetostrictive material which, when subjected to a magnetic field in a direction parallel to longitudinal axis 14, changes its dimension, and more specifically contracts, along longitudinal axis 14 in correspondence with an increase in the intensity of the magnetic field component parallel to longitudinal axis 14. Within a given range of magnetic field intensity values (normally 0 to 1.5 teslas), such deformation is substantially linear.

In a preferred embodiment, the magnetostrictive material used is TERFENOL (registered trademark) which comprises an alloy of rare metals and ferromagnetic materials. A 10 cm long TERFENOL cylinder contracts approximately 0,1–0,4 mm when subjected to a magnetic field of 1 tesla intensity; deformation may be regulated to a precision of a few microns, and occurs at a rate of up to 1700 m/s with accelerations of up to 4500 m/s2.

To reduce the reluctance of the magnetic circuit of each coil 15, supporting bodies 10 and guides 11 are made of normal ferromagnetic material, so that a fairly low current, and hence fairly little electric power, is sufficient to generate a relatively high-intensity magnetic field (up to 2 teslas) in each actuating body 13.

Cutting unit 1 further comprises a central control unit 16, which supplies coils 15 with the same electric current of variable intensity; two encoders 17 connected to central control unit 16 and for determining the angular position of respective shafts 5; two linear encoders 18 connected to central control unit 16 and for determining the position of respective supporting bodies 10, and hence respective shafts 5, in adjusting direction 7; and at least a load cell 19 connected to central control unit 16 and for determining the force exerted by the respective supporting bodies 10 on respective actuating body 13 in adjusting direction 7.

Central control unit 16 comprises a known processing unit (not shown) in turn comprising a known memory unit (not shown), and which, by means of respective known I/O devices (not shown), is input-interfaced with encoders 17, encoders 18 and load cell 19, and is output-interfaced with the respective coil 15.

The memory of central control unit 16 stores the spatial relationship of rollers 3 enabling each pair of corresponding blades 8 to operate according to the required law of interaction; which spatial relationship is represented in the memory of central control unit 16 by a table, which assigns to each angular position of rollers 3 a given distance, measured in adjusting direction 7, between corresponding points along axes 4 of rollers 3.

In actual use, central control unit 16 reads, instant by instant, the angular position of rollers 3 with respect to respective axes 4, and, as a function of said angular position, adjusts the distance between axes 4 of rollers 3 according to the values stored in the memory, to enable blades 8 in each pair of corresponding blades 8 to cooperate at the cutting station according to the required law of interaction.

Central control unit 16 adjusts the distance between axes 4 of rollers 3 by adjusting the intensity value of the magnetic field on each actuating body 13. For example, an increase in the intensity value of the electric current supplied to each coil 15 increases the intensity value of the magnetic field on actuating bodies 13, so that, by virtue of said magnetostrictive properties, each actuating body 13 contracts in adjusting direction 7, and, by virtue of the action of springs 12, the two shafts 5, and hence rollers 3, are brought closer together to reduce the distance between axes 4.

In a further embodiment, coils 15 of the two actuating bodies 13 are controlled independently to simultaneously adjust the distance between and the mutual inclination of rollers 3 in the plane defined by axes 4.

The interaction force exerted between two mutually-cooperating blades 8 is transmitted to supporting bodies 10 of rollers 3, and results in rollers 3 being parted slightly in opposition to springs 12 to reduce the force exerted by springs 12 on actuating body 13. Consequently, the maximum interaction force exchanged between blades 8 during the cutting operation equals the maximum reduction, during the cutting operation, in the pressure exerted by springs 12 on actuating body 13.

In actual use, cutting unit 1 provides for a continuous self-adaption process by which to automatically adapt the distance values, stored in the memory of central control unit 16, between axes 4 of rollers 3. According to which process, central control unit 16 reads, instant by instant and by means of load cell 19, the variation in pressure exerted by springs 12 on actuating body 13 in the course of a cutting operation by a given pair of corresponding blades 8, and, if the value of the variation—which, as stated, corresponds to the value of the interaction force between the two blades —shows a tendency to depart from said given range of values, central control unit 16 adjusts the distance value between axes 4 of rollers 3 to keep the variation value within the given range. The adjustment may be made partly or entirely in the course of the next revolution of rollers 3.

Cutting unit 1 also provides for an initial automatic learning step by which to automatically learn the distance values, stored in the memory of central control unit 16, between axes 4 of rollers 3. According to which process, central control unit 16 memorizes nominal distance values between axes 4 for each angular position of rollers 3; and these values are then corrected—in exactly the same way as described above for the self-adaption process—at an initial operating stage of rollers 3, normally performed at reduced speed and, at least initially, with no material 2 fed between rollers 3.

In a further embodiment not shown, unit 1 performs, by means of two rollers 3, processing operations other than cutting, and each of which is characterized by the two rollers 3 comprising respective tools and cooperating mutually according to a given law of interaction depending on the spatial relationship between the two rollers 3. In particular, unit 1 may perform an embossing operation, in which case, adjusting direction 7, i.e. the direction in which the mutual position of axes 4 of rollers 3 is adjusted, is preferably crosswise to axes 4.

In a further embodiment not shown, the mutual position of axes 4 of the two rollers 3 is adjusted in more than one adjusting direction 7, normally perpendicular to one another. In particular, adjusting directions 7 may be two or three in number, depending on the law of interaction between the tools on the two rollers 3.

In a further embodiment not shown, actuating bodies 13 are made of electrostrictive material, i.e. a material which is deformed when subjected to an electric field, so that coils 15 are replaced by similar devices for producing a variable electric field on actuating bodies 13.

As compared with known units of the same type, the sheet material processing unit described above provides for considerable advantages by enabling the pairs of corresponding tools on the two rollers 3 to operate in the best conditions at all times, i.e. according to the required law of interaction.

Moreover, maintenance costs are reduced by substantially eliminating complex initial and periodic adjustment of the processing unit.

Finally, high-quality work is assured by the magnetostrictive materials used enabling precise adjustment—measurable in microns—and rapid intervention—in the order of 0.1 thousandth of a second.

What is claimed is:

1. A method of processing sheet material by a unit comprising two rollers (3), which are rotatable about respective substantially parallel axes (4), actuating means (13) made of electromagnetically strictive material for connecting said two rollers (3), at least one coil of conductive material (15) wound around said actuating means (13), and a control unit (16) comprising a memory; each roller (13) comprising at least one tool (8); the tools (8) of said respective rollers (3) cooperating mutually for processing said sheet material and exerting, during the mutual cooperation, an interaction force correlated with the distance of said axes (4) and wear of the tools (8); said method comprising the steps of:

acquiring values of angular positions of said rollers (3);

acquiring values of said distance between said axes (3) when said tools (8) cooperate for processing said sheet material;

acquiring values of said interactive force;

storing said values of angular positions, distance, and interaction force in the memory of said control unit (16);

adjusting the distance between said axes (4) instant by instant by varying an electric current in said coil (15) for changing an electromagnetic field acting on said actuating means (13) made of electromagnetically strictive material; the varying of said current being a function of said stored values of angular positions, distance, and interactive force.

2. A method as claimed in claim 1, wherein said actuating means (13) is made of magnetostrictive material, and said adjustment is made by varying a magnetic component of said electromagnetic field.

3. A method as claimed in claim 1, wherein said actuating means (13) is made of electrostrictive material, and said adjustment is made by varying an electric component of said electromagnetic field.

4. A unit for processing sheet material comprising, two rollers (3) having tools (8) cooperating mutually for processing said sheet material; drive means for rotating the two rollers (3) around respective substantially parallel axes (4); at least one actuating body (13) made of electromagnetically strictive material and connected to at least one of said rollers (3) and oriented substantially perpendicular to said axes (4); a coil (15) wound around said actuating body (13) for producing a variable electromagnetic field acting on said actuating body (13); two first sensors (17) for detecting respective angular positions of said rollers (3); at least one second sensor (18) for detecting the distance between said axes (4); at least one load sensor (19) for detecting an interacting force exerted by said cooperating tools (8) when processing said sheet material; and a control unit (16) comprising a memory for storing the values detected by said first sensors (17), second sensor (18) and load sensor (19) and varying current in said coil (15) for changing the length of said electromagnetically strictive material as a function of the values detected by said first sensors (17), second sensor (18), and load sensor (19), so that the distance between said axes (4) is proportional to said current, said values being detected by said sensors instantaneously as said rollers are rotated and said distance between said axes of said rollers are adjusted instantaneously due to said electromagnetically strictive material of said actuating body.

5. A unit as claimed in claim 4, wherein said actuating body (13) is interposed between said two rollers (3).

6. A unit as claimed in claim 4, further comprising at least two supports (10) for said rollers (3); said two supports (10) being so mounted as to move with respect to each other in an adjusting direction (7) by said adjusting means (16).

7. A unit as claimed in claim 6, further comprising elastic means (12) for pushing said two rollers (3) towards each other in said adjusting direction (7).

8. A unit as claimed in claim 6 or 7, wherein said two rollers (3) are two cutting rollers (3), and said adjusting direction (7) is perpendicular to said axes (4) of the two cutting rollers.

9. A unit for processing sheet material comprising, two rollers (3) having tools (8) cooperating mutually for processing said sheet material; drive means for rotating the two rollers (3) around respective substantially parallel axes (4); each roller (3) comprising a supporting body (10), at least one supporting body being movable along a prismatic guide (11) perpendicular to said axes (4); at least one actuating body (13) made of electromagnetically strictive material, said actuating body being connected to at least one of said rollers (3) and oriented substantially perpendicular to said axes (4); a coil (15) wound around said actuating body (13) for producing a variable electromagnetic field acting on said actuating body (13); two first sensors (17) for detecting respective angular positions of said rollers (3); at least one second sensor (18) for detecting the distance between said axes; at least one load sensor (19) for detecting an interacting force exerted by said cooperating tools (8) when processing said sheet material; and a control unit (16) comprising a memory for storing the values detected by said first sensors (17), second sensor (18) and load sensor (19) and varying a current in said coil (15) for changing an electromagnetic field acting on said actuating body (13) made of electromagnetically strictive material as a function of the values detected by said first sensors (17), second sensor (18), and load sensor (19), the distance between said axes (4) being proportional to said current, said values being detected by said sensors instantaneously as said rollers are rotated and said distance between said axes of said rollers being adjusted instantaneously due to said electromagnetically strictive material of said actuating body.

* * * * *